US006581434B2

(12) United States Patent
Vilches et al.

(10) Patent No.: US 6,581,434 B2
(45) Date of Patent: Jun. 24, 2003

(54) MULTI-DIRECTIONAL VEHICLE FRAME STRAIGHTENING SYSTEM

(76) Inventors: Jose Ivan Vilches, 66 Second St., Clifton, NJ (US) 07011; Hector P. Vilches, 74 Georgia Ave., Lake Hopatcong, NJ (US) 07849

( * ) Notice: Subject to any disclaimer, the term of this patent is extended or adjusted under 35 U.S.C. 154(b) by 149 days.

(21) Appl. No.: 09/810,099

(22) Filed: Mar. 19, 2001

(65) Prior Publication Data

US 2002/0170338 A1 Nov. 21, 2002

(51) Int. Cl.[7] ..... B21D 1/12
(52) U.S. Cl. ..... 72/447; 72/705
(58) Field of Search ..... 72/447, 705

(56) References Cited

U.S. PATENT DOCUMENTS 3,029,859 A * 4/1962 Grant ..... 72/705
5,224,371 A * 7/1993 Vierto ..... 72/705

* cited by examiner

*Primary Examiner*—Lowell A. Larson
(74) *Attorney, Agent, or Firm*—M. K. Silverman

(57) ABSTRACT

A vehicle frame straightening system includes a rigid vertical post secured to a rigid base and a circumferential post sleeve slidably mounted about an upper segment of the post. The system further includes an elongate pulling member including a frame engagement element at one end and a circumferential sleeve slidably mounted about a central segment of the pulling member, the sleeve having a frame-opposing end and a fame-distal end. An axle is transversely mounted upon the post sleeve to which is pivotally secured the pulling sleeve member. The system also includes first and second linear position actuation elements, the first of which is pivotally mounted to the first sleeve above the axle. Selectable actuation of the second linear position actuation element effects incremental linear pulling of the pulling member inclusive of the frame engagement elements of the system.

6 Claims, 5 Drawing Sheets

Prior Art

MULTI-DIRECTIONAL VEHICLE FRAME STRAIGHTENING SYSTEM

BACKGROUND OF THE INVENTION

1. Subject Area

This invention relates to improvements in the straightening of rigid frames and sheet metal surfaces, such as frames, bodies and doors of a vehicle and, more particularly, apparatus for the straightening thereof by the simultaneous application of multi-directional forces exerted by power devices.

2. Prior Art

The straightening of vehicle frames and sheet metal products by mechanical means is well known and has been practiced for many years as, for example, is reflected in U.S. Pat. No. 3,492,855 (1970) to Wylie; U.S. Pat. No. 3,796,084 (1974) to Jarman; U.S. Pat. No. 3,506,777 (1975) to Dickens; U.S. Pat. No. 4,257,255 (1981) to Sanchez; and U.S. Pat. No. 4,658,629 (1987) to Grace. A typical prior art structure is shown in FIG. 1.

Generally, frame-straightening systems are extremely bulky, require considerable space to operate, and represent a high capital cost to a body shop or other establishment. Also, the precision of operation of such machines, particularly when multi-directional forces would be useful in addressing a given straightening job, is lacking because it is difficult to control the forces applied by such machines, and it is also difficult to apply multi-directional components of pulling force to the workpiece.

In view of the above limitations of such conventional, heavy, large and imprecise frame and sheet metal straightening systems, it has been difficult to repair automobiles of the past which, typically, made use of a semi-rigid body or shell segments placed over a rigid frame. Nonetheless, the prior art is more suitable to the repair of such automobiles because vehicle manufacturers then employed large tolerances between body panels. However, with the advent of modern manufacturing techniques, most vehicles now produced are of a uni-body type construction, in which the frame component is largely eliminated by a tight integration, at low tolerance, of several smaller semi-rigid sub-assemblies. This low tolerance integration causes an entire vehicle, not simply the impacted area, to distort upon a collision, thereby magnifying the damage and cost of repair in the event of an accident. Furthermore, the strength and rigidity of uni-body vehicles are highly dependent on the above referenced close tolerances between the constituent sub-assemblies. Therein, body shop professionals are now aware that prior art straightening machines lack the ability to apply and regulate small movements, as well as to control the directionality thereof, required to repair the body of such modern vehicles.

Responsive thereto, the within inventor has developed a system capable of effecting small controlled movements of a powerful apparatus that, when physically anchored to a vehicle to be repaired, permits the operator to controllably restore the normal dimension and curvature of damaged uni-body segments. Such small controlled movements are made possible through the elimination of the use of chains, as are common in the prior art (see for example Grace, U.S. Pat. No. 4,658,628 above). Furthermore, the elimination of the chain in a straightening apparatus, as is further set forth below, renders it possible to impart pulling forces in multiple directions, that is, not simply to apply a linear pulling force. Because of this, an operator of the present system can combine multiple prior art movements into a single movement that would otherwise have required multiple operations.

In addition to the particular application of the present invention to present day small tolerance uni-body vehicles, the time of repair of vehicles, regardless of vintage, is substantially decreased.

SUMMARY OF THE INVENTION

The present invention relates to a vehicle frame straightening system including a rigid vertical post secured to rigid base; a circumferential post sleeve slidably mounted about an upper segment of said post; and an elongate pulling member including frame engagement means at one end thereof. The system also includes a circumferential sleeve slidably mounted about a central segment of said pulling member, said sleeve having a frame-opposing end and a frame-distal end. An axle is transverely mounted upon said post sleeve to which is pivotally secured said pulling member sleeve. Further included in the system is first linear position actuation means (LPPAM) pivotally mounted to said first sleeve above said axle, said first LPPAM having a drive end and a driven end, said driven end pivotally spool-coupled to said frame-opposing end of said pulling member sleeve. First and second scissors arms are pivotally coupled to each other at opposing ends thereof in which said first arm is also pivotally secured to said distal end of pulling member and said second arm is pivotally secured to said frame-distal end of said pulling member sleeve. Finally, there is provided a second LPPAM having a drive end and a drive end which is secured transversely between said scissors arms. Said drive end is spool-coupled to said first arm and said driven end is coupled in a linear incremental advance relationship to said second arm. Resultantly, selected actuation of said first LPPAM rotatably calibrates the angle of action of said elongate pulling member on the vehicle frame. Selectable actuation of said second LPPAM effects incremental linear pulling of said pulling member inclusive of said frame engagement means thereof. Each of said LPPAM preferably comprises a screw and worm gear assembly, although hydraulic means may also be used.

It is a primary object of the present invention to provide an improved vehicle body and frame-straightening apparatus particularly adapted for use with low tolerance uni-frame body type vehicles.

It is another object to provide an apparatus of the above type capable of efficiently imparting fine increments of multi-directional forces within a single pulling operation.

It is a further object of the invention to provide an apparatus of the above type that will provide for more efficient, less time consuming vehicle repair.

It is a yet further object to provide a vehicle straightening apparatus of the above type having reduced size, cost and weight as opposed to vehicle frame straightening apparatus that are known in the prior art.

The above and yet other objects and advantages of the invention will become apparent from the hereinafter set forth Brief Description of the Drawings, Detailed Description of the Invention, and claims appended herewith.

DETAILED DESCRIPTION OF THE INVENTION

Figure 1:
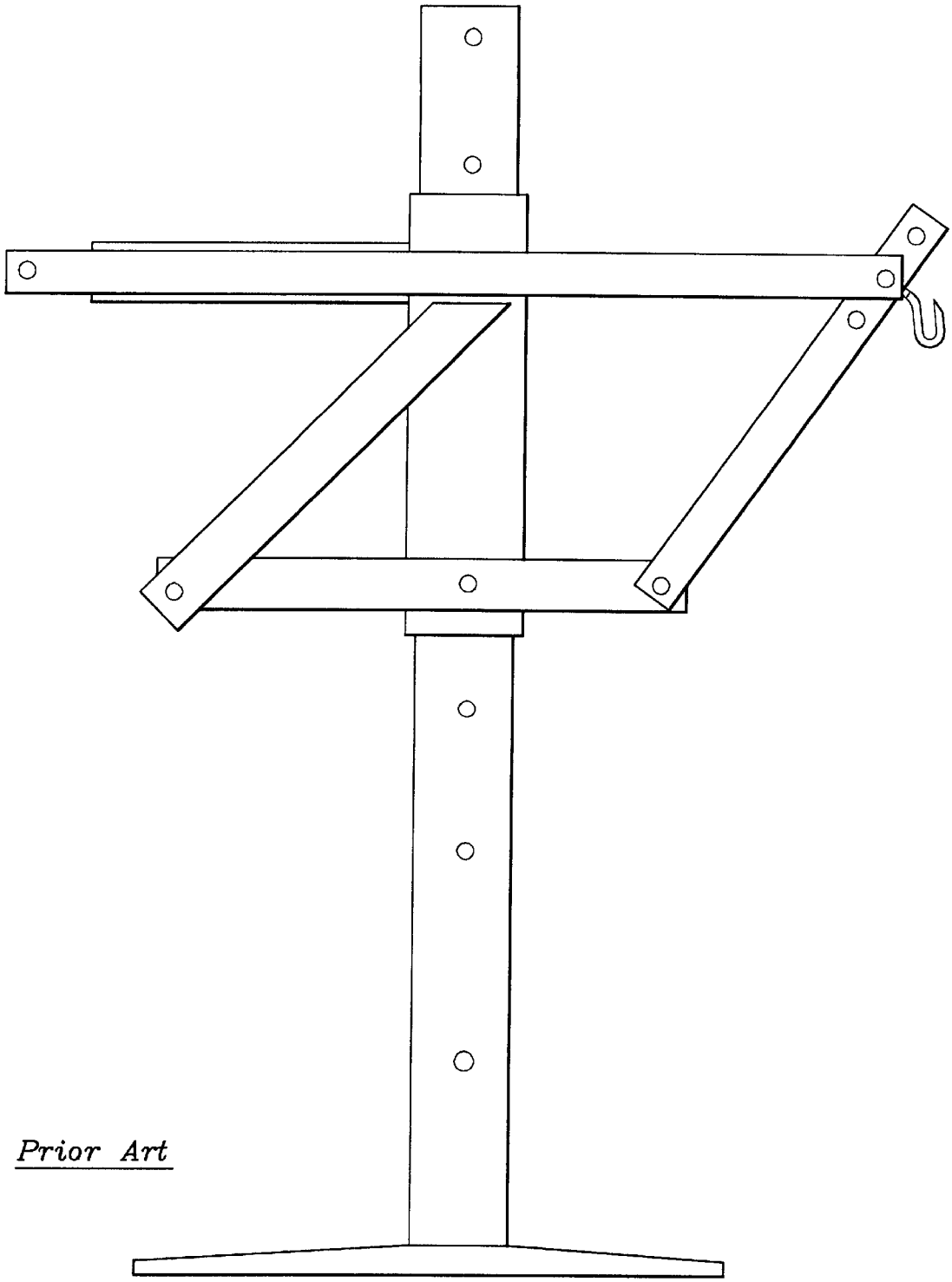
FIG. 1 is a conceptual view showing a prior art system.
Figure 2:
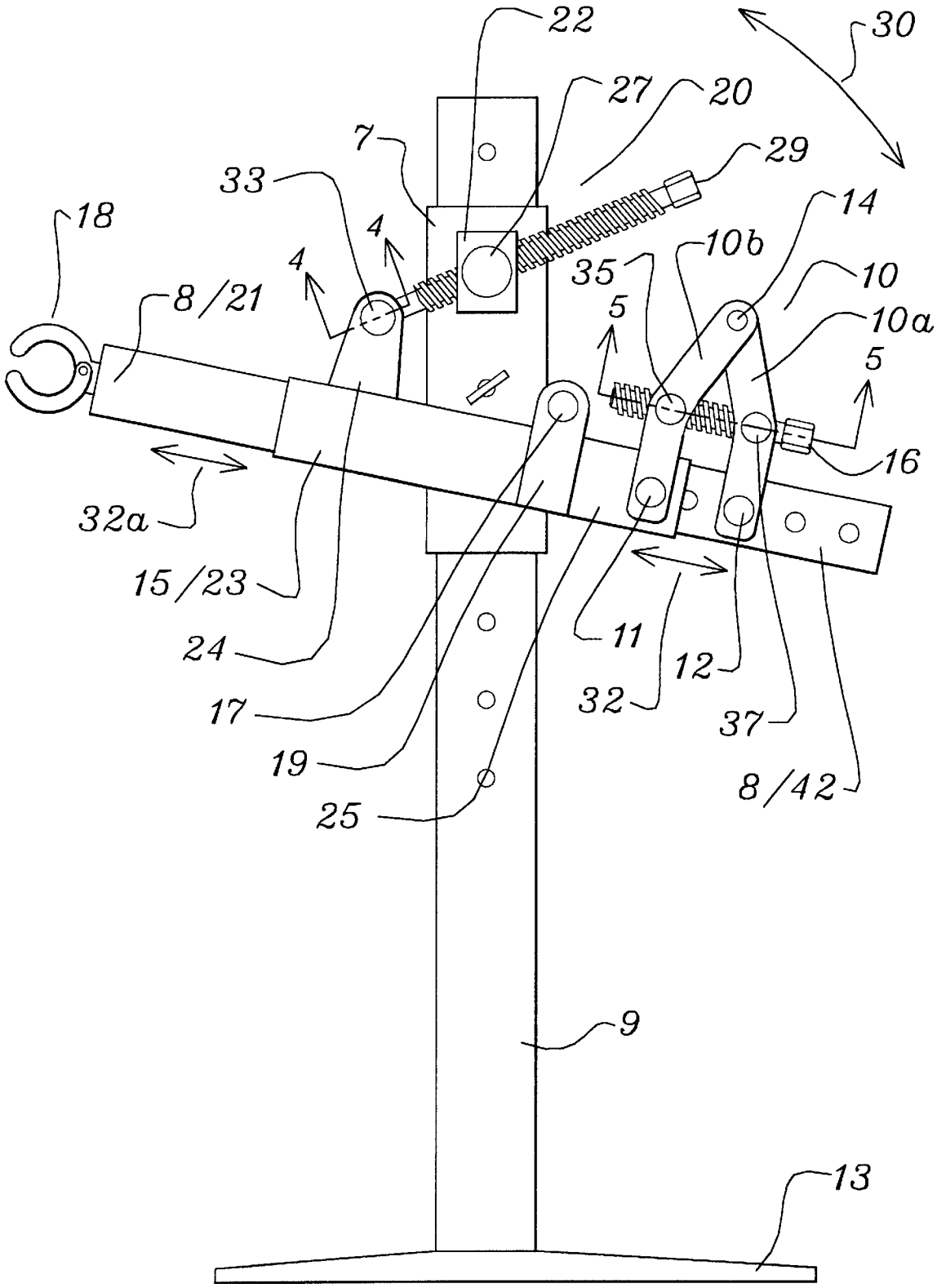
FIG. 2 is a side elevational view of the present vehicle frame straightening apparatus.

With reference to FIG. 2, the present vehicle frame straightening system may be seen to include a rigid post 9 which is vertically secured to a weighted rigid base 13. About said post is provided a circumferential post sleeve 7 which is adjustably mounted about an upper segment of the post 9.

Figure 4:
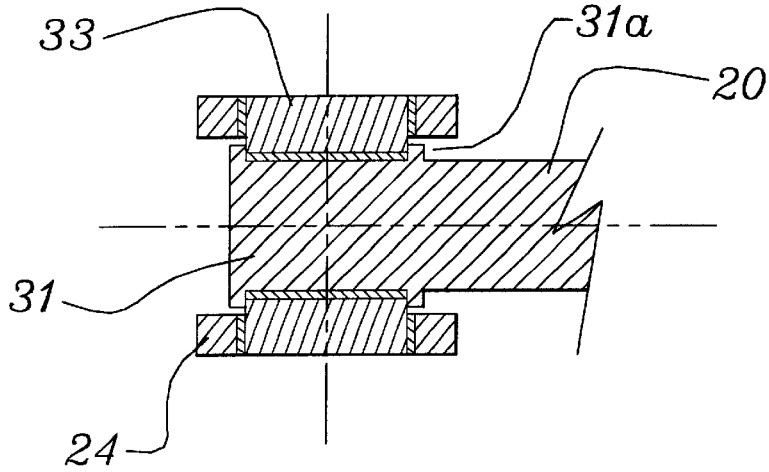
FIG. 4 is an axial a cross-sectional view taken along Line 4—4 of FIG. 2.

There is further provided an elongate pulling member 8 which includes frame engagement means 18 at a frame opposing end 19 thereof. A circumferential sleeve 15 is slidably mounted about a central segment of said pulling member 8, which sleeve includes a frame opposing end 23 and a frame distal end 25. See also FIG. 4. It is to be understood that frame engagement means 18 is typically a clamping device which enables direct transfer of forces of the elongate pulling member 18 to damaged sheet metal of the vehicle to be repaired.

Figure 3:
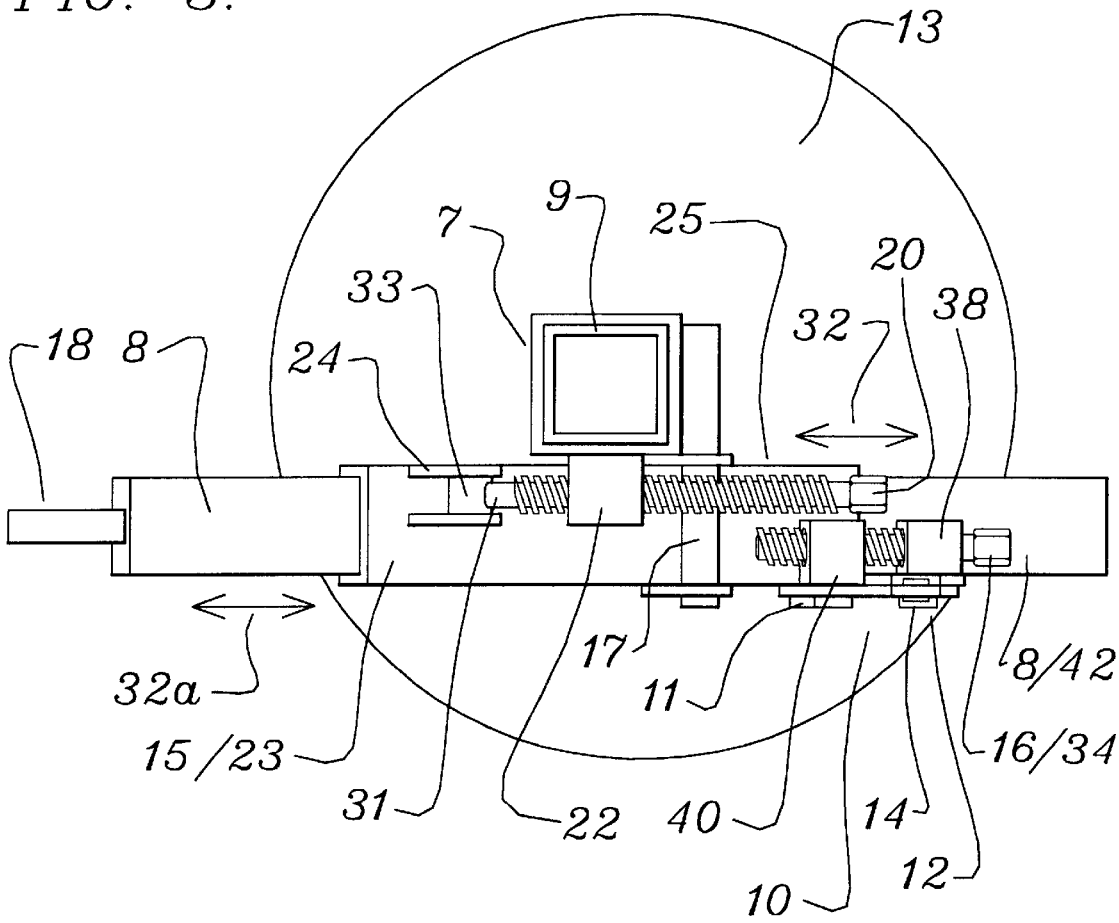
FIG. 3 is a top plan view of the apparatus of FIG. 2.

With reference to FIGS. 2 and 3 may be seen an axle 17 having a segment thereof rigidly transversely secured to said circumferential post sleeve 7, as, for example, by welding of said axle thereto. About a forward segment of axle 17 is provided a pivot collar 19 which in turn is secured to said circumferential sleeve 15, thereby enabling rotational movement of said sleeve 15 and pulling member 18 about the axis defined by axle 17.

At an upper portion of said post sleeve 7 is provided a worm gear journal 27 which is pivotally mounted by housing to said post sleeve 7. Thereby first screw means 20, having a drive end 29 and a driven end 31 (see FIG. 4) may pass through worm gear journal 27. Said driven end 31 of screw means 20 employs an annular collar 31 a to complementally engage bearing elements 33 which are themselves in axial pivot relationship to journal assembly 24. See FIGS. 3 and 4. Therein, journal assembly 24 is integrally secured to proximal end 23 of pulling member sleeve 15 as is shown in FIG. 2. Resultingly, any rotational advance of screw means 20 will advance driven end 31 which will transmit the linear component of such rotation to bearings 33 which in turn will transmit the linear component of force of screw means 20 to said bearing elements, to journal assembly 24, to sleeve 22 and, ultimately, to pulling member 8 and vehicle engaging means 18. Such force tilts member 8 in the manner shown by curved arrows 30. Due to the pivotal connection of housing 27 between first screw means 20 and post sleeve 7, transmission of a vertical linear component of the force and motion of rotation of screw means 20 can occur regardless of the angulation of pulling member 8 relative to base 13.

It is to be understood that said first screw means 20 is representative of but one of class of linear position power actuation means (LPPAM). That is, equivalents of said screw means such as electrical, pneumatic, or hydraulic linear position actuation as may be utilized in lieu thereof. It is also noted that pneumatic of hydraulic means may be used to effect rotation of screw means 20.

Figure 5:
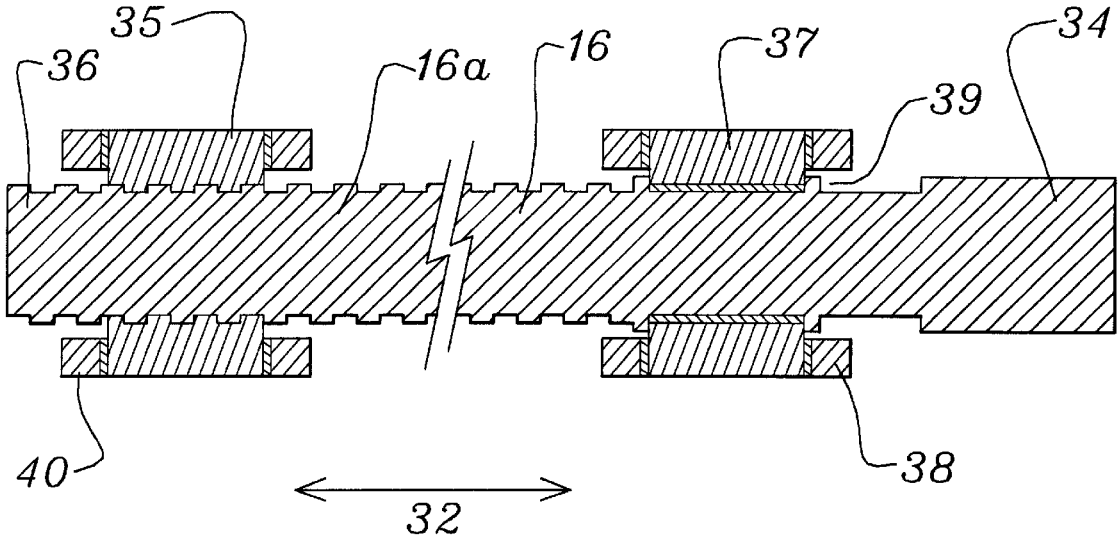
FIG. 5 is an axial cross-sectional view taken along Line 5—5 of FIG. 2.

With further reference to FIGS. 2, 3 and 5, there are shown first and second scissors arm 10*a* and 10*b* respectively which are attached at pivot points 12 and respectively 11 to said pulling member 8 and distal end 25 of said pulling member sleeve 15 respectively. Said scissors arms are pivotally secured at point 14 so as to define a scissors arm assembly 10. Relative motion of said scissors arms 10*a* and 10*b* is accomplished by second screw means 16 having a drive end 34 and a driven end 36 (see FIG. 5). Thereby, through rotation of said second screw means 16, rotation will occur against spool bearings 37 of spool journal 38 and, with respect to a threaded portion 16*a* of screw means 16 (shown to the left of FIGS. 2, 3 and 5), engagement of driven end 36 with worm gear journal 35 will occur. As may be appreciated, said worm gear journal 35 is also pivotally secured within a driven end journal housing 40 while spool bearings 37 are also pivotally secured within said spool journal 38, each of which may be more fully seen in the top view of FIG. 3. Resultingly, the linear component of rotational motion of second screw means 16 will be transmitted to spool bearings 37 because of annular spool engaging collar 39 (see FIG. 5) of second screw means 16. Resultingly, the linear component of such rotation of second screw means 16 will be communicated from collar 39 to bearings 37 to pivoted spool journal 38 and, therefrom, to first scissors arm 10*a*. Said component is then transmitted to a distal area 42 of pulling member 8.

Figure 5A:
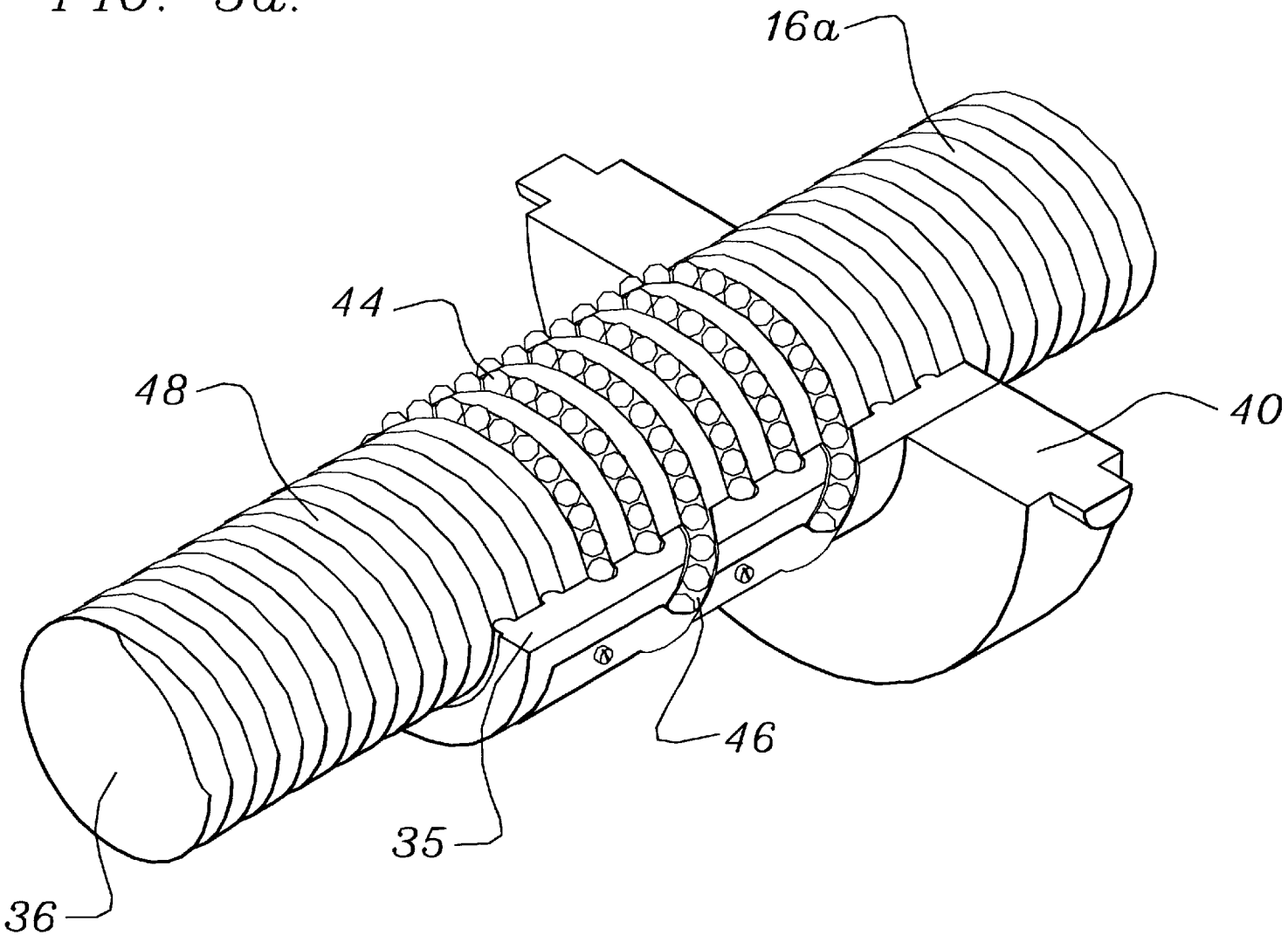
FIG. 5A is a breakaway perspective view of the ball bearing spool journals of FIG. 5.

In FIG. 5A is shown a breakaway perspective view of the left side of screw means 16 which includes ball groove surface 16*a*, said journal housing 40 (which also serves as a ball nut flange), said worm gear journal (or ball nut) 35, driven end 36 of said screw means 16, load carrying ball bearings 44, and ball bearing return tubes 46. Thereby, the ball groove surface 16*a* may be seen to include a hardened ball race 48. Journal/nut 35 includes said bearing balls circulating in said race. The bearing balls are transferred from one end of the journal/nut 35 to the other by the return tubes 46. In a ball bearing screw, like the one shown, two complete ball bearing circuits are used to increase both the load carrying capacity of the screw and its operating life. The primary function of the ball bearing screw is to convert rotary motion to linear motion, that is, torque to thrust.

A similar structure is employed in the spool journal 38 at the right of FIG. 5, and in sleeve 22 of first screw means 20.

The transmission of the thrust or linear component of force of second screw means 16 is shown conceptually by dual arrows 32 in FIGS. 2 and 3, while the resultant effect thereof is shown by dual arrows 32*a* at frame opposing end 21 of pulling member 8. Thereby small incremental changes of position and, thereby, force are transmitted to pulling member 8 along the linear axis thereof, while another linear force, having a vertical component, is transmitted by said first screw means 20 and related assembly, described above. Accordingly, a selectable combination of horizontal and vertical components of linear forces is transmitted by the present apparatus.

In operation, first screw means 20 is typically used to vary the angle of pulling member 8 relative to said post 9, thereby creating, in force 32*a*, a single pulling force, however, one having a selectable ratio of vertical to horizontal components. It is further noted that because axle collar 19 and journal assembly 24 ensure rigidity of pulling sleeve 15 relative to post sleeve 7, linear force 32, generated from scissors assembly 10, will be efficiently transmitted to pulling member 8 and frame engagement means 18. It is noted that second screw means 16, as in the case of first screw means 20, may be replaced by other linear position actuation means such as electrical, pneumatic or hydraulic linear displacement devices as are well known in the art and may itself be pneumatically or hydraulically powered.

It is to be appreciated that the above-described system provides for considerable precision of calibration with respect to the quantum of force and the angle of action of elongate pulling member 8 upon the vehicle frame or body thereby particularly enabling it to address the narrow tolerances which characterize the above-described tight integration of small semi-rigid sub-assemblies of contemporary uni-body vehicles.

Figure 6:
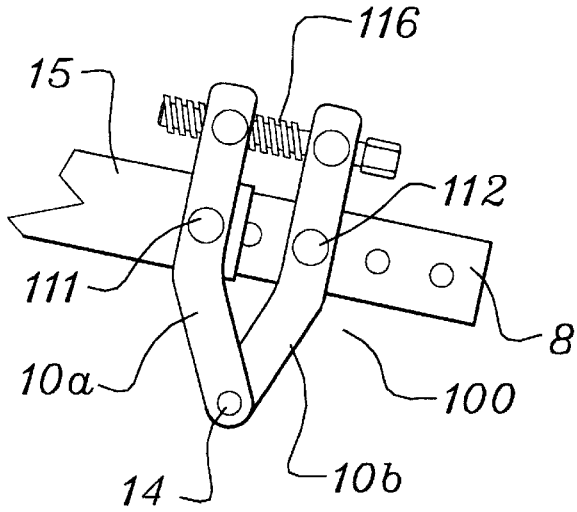
FIG. 6 is a view of an alternative embodiment of the scissors arm LPPM portion of the invention.

In FIG. 6 is shown an alternate embodiment 100 of scissors arm assembly 10 of FIGS. 2 and 3. Therein second screw means 116 is located at the ends of scissors arms 10*a* and 10*b* as are the above described elements 35, 37, 38, 39 and 40 which facilitate transmission of the linear component of the rotational motion of the screw means 116 to pivot 112 and, thereby, to elongate pulling member 8.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

We claim:

1. A vehicle frame straightening system, comprising:

(a) a rigid post vertically secured to a rigid base;

(b) a circumferential post sleeve slidably mounted about an upper segment of said post;

(c) an elongate pulling member including frame engagement means at one end thereof;

(d) a circumferential sleeve slidably mounted about a central segment of said pulling member, said sleeve having a frame opposing end and a frame-distal end;

(e) an axle having one segment thereof rigidly mounted transversely upon said circumferential post sleeve;

(f) means for pivotally securing said pulling member sleeve, at a medial location thereof, to another segment of said axle;

(g) first linear position power actuation means (LPPAM) pivotally mounted to said post sleeve above said axle, said first LPPAM having a drive end and a driven end, said driven end pivotally spool-coupled to said frame-opposing end of said pulling member sleeve;

(h) first and second scissors arms pivotally coupled to each other at opposing ends thereof, said first arm also pivotally secured to a distal end of said pulling member and said second arm pivotally secured to a frame-distal end of said pulling member sleeve; and (i) second LPPAM having a drive end and a driven end, said drive end secured transversely between said scissor arms, said drive end spool-coupled to said first arm and said driven end coupled in a linear incremental advance relationship to said second arm, whereby selectable actuation of said first LPPAM will rotatably calibrate the angle of action of effect of said elongate pulling member on the vehicle frame and selectable actuation of said second LPPAM will control incremental linear pulling of said elongate member and said frame engagement means thereof.

2. The system as recited in claim 1 in which said first LPPAM comprises a screw assembly.

3. The system as recited in claim 1 in which said driven end of said second LPPAM comprises a screw and worm gear assembly.

4. The system as recited in claim 2 in which said driven end of said second LPPAM comprises a screw and worm gear assembly.

5. The system as recited in claim 1 in which both LPPAM are pneumatic.

6. The system as recited in claim 1 in which both LPPAM are hydraulic.

* * * * *